US009371601B2

(12) United States Patent
Westphal et al.

(10) Patent No.: US 9,371,601 B2
(45) Date of Patent: Jun. 21, 2016

(54) CRIMPING APPARATUS

(71) Applicant: Oerlikon Textile GMBH & Co. KG, Remscheid (DE)

(72) Inventors: Jan Westphal, Schülp (DE); Mathias Stündl, Wedel (DE); Claus Matthies, Ehndorf (DE)

(73) Assignee: OERLIKON TEXTILE GMBH & CO. KG, Remscheid (DE)

( * ) Notice: Subject to any disclaimer, the term of this patent is extended or adjusted under 35 U.S.C. 154(b) by 147 days.

(21) Appl. No.: 14/476,015

(22) Filed: Sep. 3, 2014

(65) Prior Publication Data

US 2014/0366348 A1 Dec. 18, 2014

Related U.S. Application Data

(63) Continuation-in-part of application No. PCT/EP2013/054126, filed on Mar. 1, 2013.

(30) Foreign Application Priority Data

Mar. 8, 2012 (DE) ..... 10 2012 004 747

(51) Int. Cl.
*D02G 1/12* (2006.01)
*D02J 13/00* (2006.01)

(52) U.S. Cl.
CPC ..... *D02G 1/125* (2013.01); *D02G 1/12* (2013.01); *D02J 13/005* (2013.01)

(58) Field of Classification Search
CPC ..... D02G 1/12; D02G 1/008; D02G 1/161; D02G 1/167; D02G 1/20; D02G 1/125; D02G 1/127; D02G 1/122; D02J 1/06; D02J 1/08; D02J 1/02; D02J 1/04; D02J 13/005
USPC ..... 28/263, 252, 268, 270, 221, 250, 257, 28/266
See application file for complete search history.

(56) References Cited

U.S. PATENT DOCUMENTS 3,311,961 A * 4/1967 Iwnicki ..... D02G 1/205 28/221
3,469,293 A * 9/1969 Megumi ..... D02G 1/12 28/266

(Continued)

FOREIGN PATENT DOCUMENTS

DE 26 32 082 1/1978
EP 0 003 952 9/1979

OTHER PUBLICATIONS

PCT/EP2013/054126 International Search Report dated May 2, 2013 (4 pages including English translation).

*Primary Examiner* — Amy Vanatta
(74) *Attorney, Agent, or Firm* — Brinks Gilson & Lione; G. Peter Nichols

(57) ABSTRACT

A crimping apparatus for crimping a filament bundle in a melt spinning process includes a conveyor nozzle and a stuffer box which is associated with the conveyor nozzle. For thermal processing, a processing unit, which includes a rotatable processing drum which, for guiding and temperature control of a thread plug, has a rotating drum wall, is disposed downstream of the stuffer box. In order to be able to carry out as gentle a processing of the thread plug as possible, the stuffer box is disposed axially parallel to the processing drum in such a manner that the thread plug can be infed in a straight run from a plug outlet of the stuffer box to the circumference of the drum wall. This allows the naturally acting weight force of the thread plug to be advantageously used for guiding the thread plug.

10 Claims, 5 Drawing Sheets

(56) References Cited

U.S. PATENT DOCUMENTS 4,024,610 A * 5/1977 Li ..... D02G 1/122 28/257
4,118,843 A * 10/1978 Schippers ..... D02G 1/125 28/255
4,301,578 A 11/1981 Dammann et al.
4,620,345 A * 11/1986 Fleissner ..... D02G 1/205 28/266
5,054,173 A * 10/1991 Schafer ..... D02G 1/127 28/263
5,088,168 A * 2/1992 Berger ..... D02G 1/122 28/248
5,974,777 A * 11/1999 Davis ..... D02J 13/005 28/255
7,150,083 B2 * 12/2006 Schemken ..... D02G 1/122 28/255
7,386,925 B2 * 6/2008 Germer ..... D02G 1/12 28/221
2004/0016092 A1 * 1/2004 Wirz ..... D02G 1/12 28/271
2009/0249765 A1 * 10/2009 Stundl ..... D02G 1/12 57/246

* cited by examiner

CRIMPING APPARATUS

This application is a continuation-in-part of PCT/EP2013/054126 filed Mar. 1, 2013, which claims priority to German Application No. 10 2012 004 747.9 filed Mar. 8, 2012; the entire contents of each are incorporated herein by reference.

BACKGROUND

The invention relates to a crimping apparatus for crimping a multifilament bundle in a melt spinning process.

In the manufacturing of crimped threads in a melt spinning process crimping of the threads is caused by stuffing the filament bundles to form in each case a thread plug. In this known process, on account of stuffing the filament bundles, the filaments are deposited as loops and arcs and compressed to form the thread plugs, such that, after disintegration of the thread plug, a thread having crimped filaments is produced. The shape of the crimp contained in the filaments here essentially depends on the thermal processing of the thread plug. In order to enable dwelling times for temperature-control of the thread plug that are as long as possible, processing units in which the thread plug produced after stuffing is guided with multiple enlacements on a processing drum have been successful in the prior art.

A crimping apparatus of such type is known from DE 26 32 082, for example. In the known crimping apparatus, a conveyor nozzle, a stuffer box and a processing unit with a processing drum are disposed below one another. In principle, two different positions of the processing drum for receiving and guiding a thread plug guided out of the stuffer box are known here. In a first variant, the axis of the processing drum is oriented substantially horizontally, such that, in the case of multiple enlacements on the circumference of the processing drum, the thread plug has to be guided substantially in the horizontal direction. In this arrangement of the processing drum the windings of the thread plug on the circumference of the drum wall have to be displaced in order to obtain a helical profile of the thread plug on the circumference of the processing drum. Depending on the properties of the drum wall, entanglements of adjacent windings of the thread plug that are more or less intense may arise here. In addition, indexing means are used. In order to axially displace the windings of the thread plug.

In a second variant of the arrangement of the processing drum, the latter, with its axis, is substantially vertically oriented, such that the helically guided thread plugs on the circumference of the processing drum experience natural support of their indexing movement on the circumference of the drum wall. To this extent, comparatively slight indexing forces are required in order to guide the helical profile of the thread plug from the upper end of the processing drum to a lower end of the processing drum. Here, infeeding of the thread plug takes place by an upstream deflection between the stuffer box and the processing chamber. Deflections of this type typically represent a zone which, for temperature control of the thread plug, is uncontrolled and, wherever possible, they should be implemented as short as possible.

SUMMARY

It is an object of the invention to provide a crimping apparatus for crimping a multifilament bundle in a melt spinning process of the generic type in which the thread plug, for thermal treatment, is guidable with multiple enlacements in a gentle manner on the circumference of a processing drum.

A further object of the invention lies in refining the crimping apparatus of the generic type in such a manner that guiding of the thread plug on the circumference of the processing drum can substantially take place without an indexing unit.

This object is achieved according to the invention in that the stuffer box is disposed axially parallel to the processing drum in such a manner that the thread plug can be infed in a straight run from a plug outlet of the stuffer box to the circumference of the drum wall.

The invention is distinguished in that the natural weight force of the thread plug may be used to infeed the thread plug, without deflection, to the processing drum. The change of direction of the thread plug on the circumference of the processing drum is caused only by the relative speeds of the thread plug and the drum wall. The processing drum which, with its axis, is vertically oriented here ensures indexing of the individual windings of the thread plug without any comparatively large indexing forces.

Guiding of the thread plug on the circumference of the processing drum may still be improved in that, according to an advantageous refinement of the invention, the drum wall, at a short distance therefrom, is associated with an outer cylinder which encompasses the cooling drum in a sleeve-like manner and in that, for guiding the thread plug, an encircling annular chamber is configured between the outer cylinder and the drum wall. Here, the thread plug may be guided immediately from the plug outlet directly to the annular chamber, such that dynamic friction existing between the thread plug and the drum wall can be reduced to a minimum.

In order to facilitate filling of the annular chamber on the circumference of the processing drum, on the one hand, and to obtain setting of the thread plug on the circumference of the drum prior to disintegration of the thread plug, on the other hand, the refinement of the invention is preferably implemented in which the annular chamber includes an inlet opening to an upper end of the outer cylinder and, between the drum wall and the outer cylinder, includes an outlet opening to a lower end of the outer cylinder, and in that the annular chamber includes a chamber cross section which tapers off in the axial direction toward the outlet opening. In this manner, the chamber cross section may be implemented so as to be preferably larger in the inlet region of the annular chamber than a diameter of the thread plug. This enables the thread plug to be directly deposited in the annular chamber immediately after stuffing and without any compression. On account of the subsequent tapering of the chamber cross section it is achieved that positive setting of the thread plug is possible in the lower region of the annular chamber. To this end, the chamber cross section, in the region of the outlet opening, includes a size that is substantially smaller than the diameter of the thread plug.

In order to obtain secure guiding within the annular chamber in the case of fine counts and correspondingly low thread weights, it is furthermore provided that the inlet opening of the annular chamber is associated with a segment-shaped holding-down element which partially covers the inlet opening. In this manner, secure guiding of the plug layers within the annular chamber is achieved even in the case of a tapering chamber cross section.

In order to obtain slight relative speeds of the processing drum and the outer cylinder, a particularly advantageous embodiment is one in which the outer cylinder is configured so as to be rotatable and is coupled to a rotational drive which drives the cylinder wall in the same direction of rotation as the drum wall of the processing drum. In this manner, the cylinder wall can be driven in the same direction of rotation as the drum wall at a circumferential speed in such a manner that no speed differential exists between the walls of the annular chamber. In order to produce special effects when guiding the thread plug, there is, in principle, however also the possibility of setting desired speed differentials between the cylinder wall and the drum wall.

In the case of a synchronous drive of the processing drum and of the outer cylinder the refinement of the invention in which the processing drum is driven by an electric motor which is coupled to the rotational drive of the outer cylinder has proven successful. In this manner, both walls can be collectively driven in the same direction of rotation by way of one electric motor.

For temperature control of the thread plug on the circumference of the processing chamber the invention offers high flexibility in the choice and implementation of the temperature-control means. In a first variant, the drum wall of the processing chamber is configured so as to be gas-permeable, wherein the processing drum is coupled to a blower for generating a flow of cooling air. In this manner, the blower in the interior of the processing drum could produce negative pressure, for example, such that the available ambient air is sucked in via the drum wall and may be used for cooling the thread plug. Alternatively, however, there is also the possibility for the blower in the interior of the processing chamber to produce positive pressure, such that a flow of cooling air from the inside to the outside is established.

Irrespective of the properties of the blower, the thread plug may also be advantageously cooled within the annular chamber, in that the outer cylinder includes a gas-permeable cylinder wall.

However, in principle there is also the possibility for a fluid to be used as a temperature-control means which, for temperature control of the drum wall, is guided through fluid ducts within the processing chamber. Cold as well as hot fluids may be used here in order to implement temperature control of the thread plug.

The invention will be explained in more detail in the following with reference to the appended figures and by means of a plurality of exemplary embodiments.

DETAILED DESCRIPTION

Figure 1:
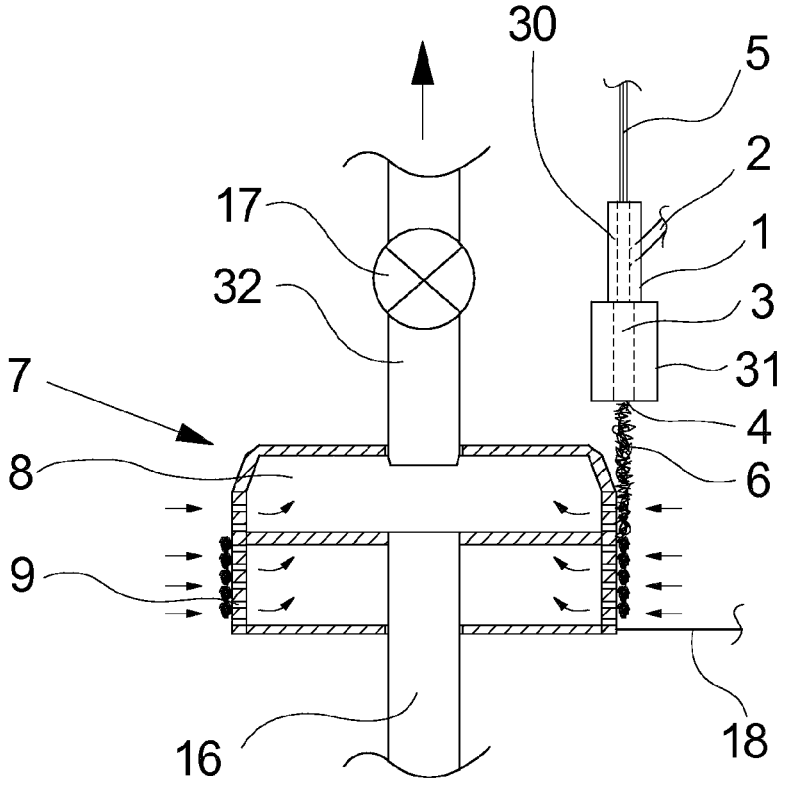
FIG. 1 shows schematically a cross-sectional view of a first exemplary embodiment of the crimping apparatus according to the invention.
Figure 2:
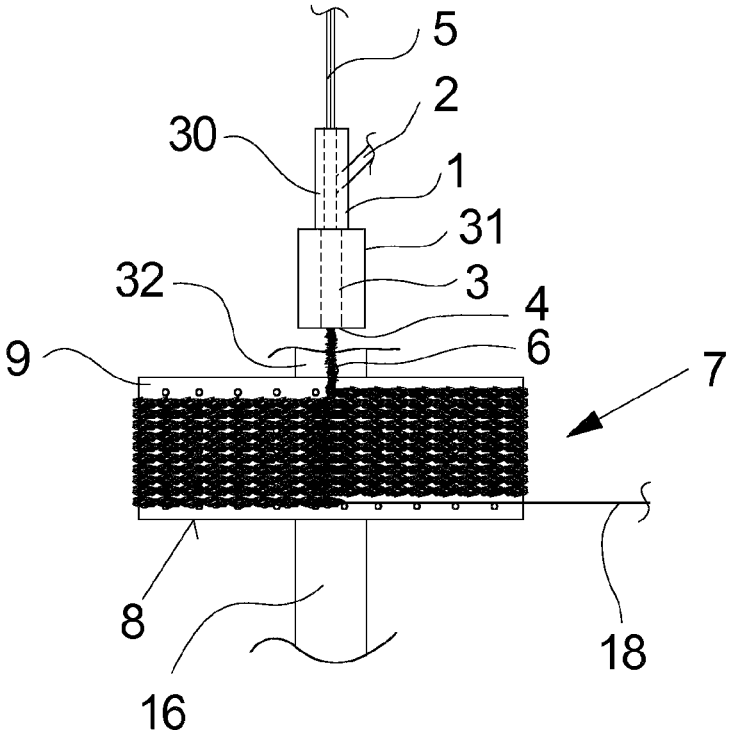
FIG. 2 shows schematically a side view of the exemplary embodiment of FIG. 1.

In FIGS. 1 and 2 a first exemplary embodiment is illustrated schematically in a plurality of views. Both illustrations show the exemplary embodiment in operation, wherein FIG. 1 shows a partial cross section of the complete apparatus and FIG. 2 shows a side view. In as far as no reference is made to any of the figures, the following description applies to both figures.

The exemplary embodiment as shown in FIGS. 1 and 2 includes a conveyor nozzle 1 which, via a fluid connector 2, is coupled to a fluid source (not illustrated here). The conveyor nozzle 1 contains a continuous guide duct 30 which is illustrated with dashed lines in FIGS. 1 and 2. The guide duct 30 penetrates the conveyor nozzle 1 and, in this manner, forms an inlet on the upper end. The lower end of the guide duct 30 of the conveyor nozzle 1 opens into a stuffer box 3. The stuffer box 3 is likewise illustrated with dashed lines in FIGS. 1 and 2 and configured in a housing 31. The housing 31, on its lower side, includes a plug outlet 4 which is connected to the stuffer box 3 in the interior of the housing 1.

A processing unit 7 is disposed below the plug outlet 4. The processing unit 7 includes a rotatable processing drum 8 which, via a drive shaft 16, is connected to a rotational drive (not illustrated here).

As can be understood from the illustration in FIG. 1, the processing drum 8 is configured as a hollow cylinder, the drum wall 9 of which includes a plurality of openings. The end sides of the processing drum 8 are closed and, via a suction duct 32, coupled to a blower 17.

The processing drum 8 is vertically oriented in relation to the drum axis, such that the drum wall 9 extends in the vertical direction from an upper end down to a lower end. The upper end of the drum wall 9, at a short distance therefrom, is associated with the plug outlet 4 of the stuffer box 3. The stuffer box 3 here is disposed axially parallel to the processing drum 8 in such a manner that a thread plug 6 is guided in a straight run between the plug outlet 4 of the stuffer box 3 and the circumference of the drum wall.

As can be seen from the illustration in FIG. 2, the thread plug is only deflected after striking the circumference of the drum wall 9, on account of the rotational movement of the drum wall 9 in the circumferential direction of the processing drum 8. Here, temperature-control produced by the processing drum 8 already sets in. The thread plug 6 is deposited on the circumference of the drum wall 9 in multiple windings as the rotational movement on the drum wall 9 continues. Disintegration of the thread plug 6 to form a crimped thread 18 only takes place at the lower end of the drum wall 9.

In the exemplary embodiment illustrated in FIGS. 1 and 2, a filament bundle 5 is continuously conveyed by the conveyor nozzle I via a preferred hot fluid, for example heated compressed air, into the stuffer box 3 and there stuffed to form a thread plug 6. For the purpose of further temperature control and setting of the crimp in the filaments, the thread plug 6 is subsequently directly infed into the processing unit 7. In this exemplary embodiment the processing unit 7 has cooling air as a temperature-control means. To this end, the blower 17 produces negative pressure in the interior of the processing drum 8, such that a suction flow from the outside to the inside is produced via the gas-permeable drum wall 9. For temperature control, in particular for cooling the thread plug 6, ambient air is used in this exemplary embodiment. By way of the suction flow, a positive grip of the windings of the thread plug 6 on the circumference of the drum wall 9 is simultaneously achieved.

Figure 3:
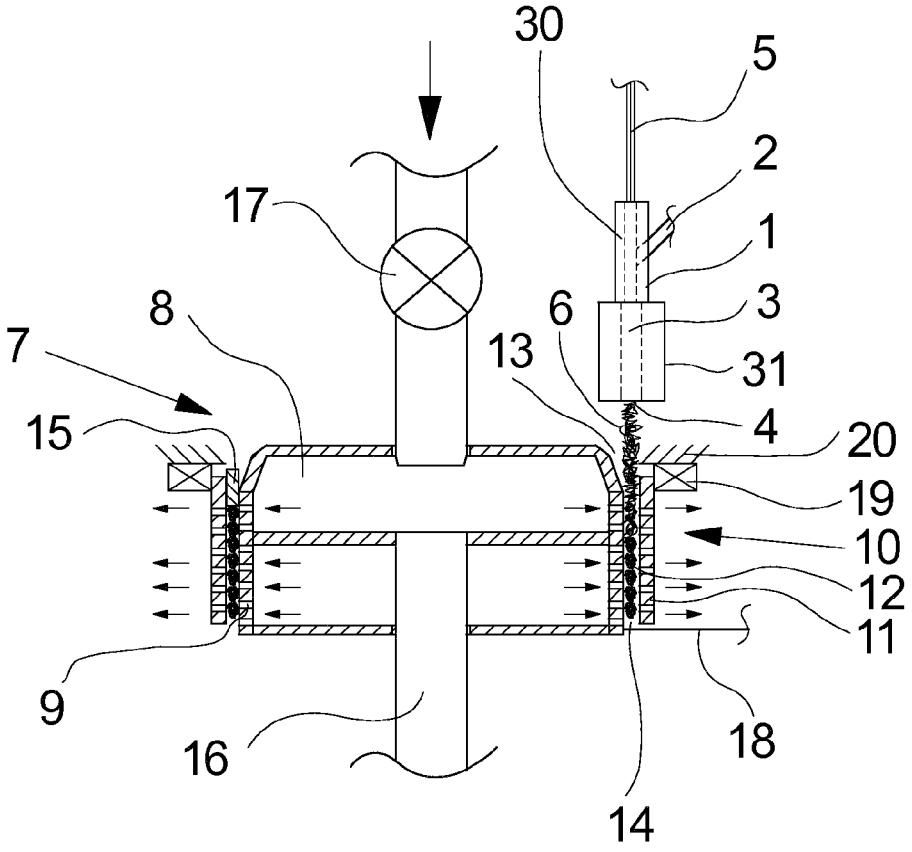
FIG. 3 shows schematically a cross-sectional view of a further exemplary embodiment of the crimping apparatus according to the invention.

In the exemplary embodiment illustrated in FIGS. 1 and 2, the flow of cooling air is used for temperature control as well as for providing a grip for the thread plug on the circumference of the drum wall 9. In order to be able to use the cooling air exclusively for temperature control, a further exemplary embodiment of the crimping apparatus according to the invention is shown in FIG. 3. The exemplary embodiment as shown in FIG. 3 is substantially identical to the exemplary embodiment as shown in FIG. 1, such that only points of differentiation will be explained in the following and reference is otherwise made to the aforementioned description.

For guiding the thread plug on the circumference of the drum wall 9, the processing drum 8 is associated with an outer cylinder 10. The outer cylinder 10 includes a gas-permeable cylinder wall 11 which is implemented in an enclosing manner, having a small spacing in relation to the drum wall 9. An annular chamber 12 for receiving the thread plug 6 is formed between the drum wall 9 and the cylinder wall 11. The annular chamber 12, on the upper end of the processing drum 8, includes an inlet opening 13 and, on the lower end of the processing drum 8, includes an outlet opening 14. The inlet opening 13 is associated with a segment-shaped holding-down element 15 which acts on the windings of the thread plug 6 that have been deposited in the annular chamber 12. The outer cylinder 10 is rotatably held by way of a bearing unit 19 on an upper support 20.

The processing drum 8 and the stuffer box 3 and the conveyor nozzle 1 are implemented in an identical manner to the aforementioned exemplary embodiment as shown in FIG. 1, such that no further explanation is offered at this point in order to avoid any repetition.

In the exemplary embodiment illustrated in FIG. 3, the thread plug 6 is guided in a straight run from the plug outlet 4 of the stuffer box 3 into the annular chamber 12 on the circumference of the drum wall 9. Setting of the windings of the thread plug on the circumference of the drum wall 9 here is substantially handled by the cylinder wall 11 of the outer cylinder 10. The outer cylinder 10 here is driven via the processing drum 8 in the same direction of rotation. For temperature control, positive pressure is produced via the blower 17 in the interior of the processing drum 8, such that a flow of cooling air permeates the windings of the thread plug 6 from the inside to the outside.

Figure 4:
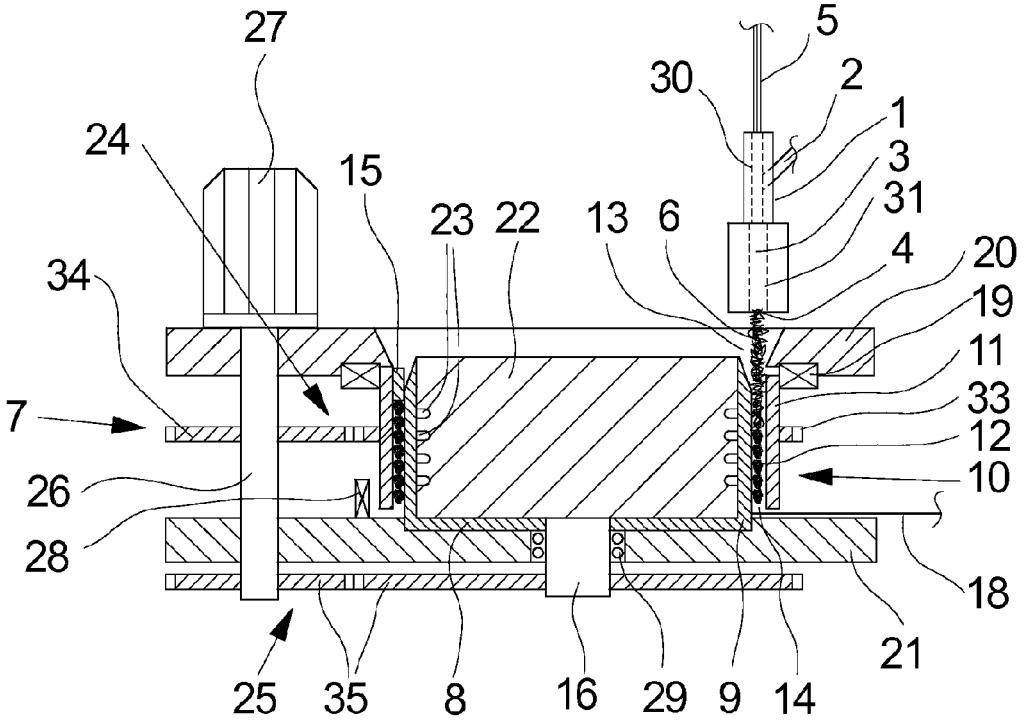
FIG. 4 shows schematically a cross-sectional view of a further exemplary embodiment of the crimping apparatus according to the invention.

In the exemplary embodiment illustrated in FIG. 3, the rotational drive of the outer cylinder 10 takes place via the driven processing drum 8. To this end, it is necessary for the windings of the thread plugs that are guided in the annular chamber 12 to be used for transmission of rotation. In order to be able to perform guiding of the thread plugs that is as unencumbered as possible, a further exemplary embodiment of the crimping apparatus according to the invention is shown in FIG. 4. In this exemplary embodiment of the crimping apparatus that is schematically shown in a cross-sectional view, the outer cylinder includes a dedicated rotational drive, such that both the drum wall 9 and the cylinder wall 11 are drivable in the same direction of rotation.

The exemplary embodiment in FIG. 4 includes a conveyor nozzle 1 and a stuffer box 3 which are implemented in an identical manner to the aforementioned exemplary embodiments.

The processing unit 7 in this exemplary embodiment is disposed between an upper support 20 and a lower support 21. The lower support 21 supports a processing drum 8 which has a cup-shaped drum wall 9. The drum wall 9 is associated with an inner annulet 22 which, on the circumference, has a plurality of fluid ducts 23. The fluid ducts 23 may be helically configured so as to be one groove or so as to be a plurality of grooves having connecting grooves. The fluid ducts 23 are coupled to a fluid infeed (not illustrated here). A temperature-controlled fluid, preferably a liquid, is guided within the fluid ducts 23, such that the inside of the drum wall 9 is directly temperature controlled by way of the fluid.

The inner annulet 22 and the drum wall 9 are connected to the drive shaft 16. The drive shaft 16, on one free end, is coupled to an electric motor 27 via a rotational drive 25.

On the upper support 20, an outer cylinder 10 is rotatably held by way of a bearing unit 19. The outer cylinder 10, with one cylinder wall 11, extends sleeve-like toward the drum wall 9 and, with the drum wall 9, forms an annular chamber 12. The annular chamber 12 includes an upper inlet opening 13 and a lower outlet opening 14. The inlet opening 13, over part of the circumference, is covered by a holding-down element 15. To this end, the holding-down element 15 is held in the upper region of the annular chamber 12.

A rotational drive 24 which is coupled to the electric motor 27 acts on the circumference of the outer cylinder 10. In this exemplary embodiment, the rotational drive 24 is formed by an encircling crown gear 33 and a gear wheel 34 which is held on a motor shaft 26.

The rotational drive 25 of the processing drum 8 is formed by a gear pair 35 which connects the drive shaft 11 with the motor shaft 26. To this end, the motor shaft 26 extends axially parallel to the processing drum 8. The electric motor 27 is disposed on the upper support 20 and directly coupled to the motor shaft 26.

The rotational drives 24 and 25 are adapted in such a manner that, when rotating the motor shaft 26, the cylinder wall 11 of the outer cylinder 10 and the drum wall 9 of the processing drum 8 can be operated without any speed differential. In this manner slippage-free guiding of the windings of the thread plug within the annular chamber 12 is possible.

For temperature control, a heating radiator 28 which enables temperature control, in this case being heating of the thread plug, in the region of the outlet opening 14 of the annular chamber 12 is associated with the lower end of the cylinder wall 11 on the lower support 21. Thermal post-processing of this type may facilitate in particular setting of the crimp in the filaments.

The function of the exemplary embodiment as shown in FIG. 4 is substantially identical to that of the exemplary embodiment as shown in FIG. 3. However, the exemplary embodiment as shown in FIG. 4 is particularly suited to performing crimping at comparatively high speeds. On account of the synchronous drive in the drum wall 9 and the cylinder wall 11 gentle plug processing is also possible in the case of comparatively high speeds.

The exemplary embodiments illustrated in FIGS. 3 and 4 include in each case an annular chamber 12 on the circumference of the processing drum 8 that is substantially formed by walls 9 and 11 which run parallel to one another. However, there is, in principle, also the possibility of configuring the annular chamber 12 having variable chamber cross sections on the circumference of the processing drum 8.

Figure 5:
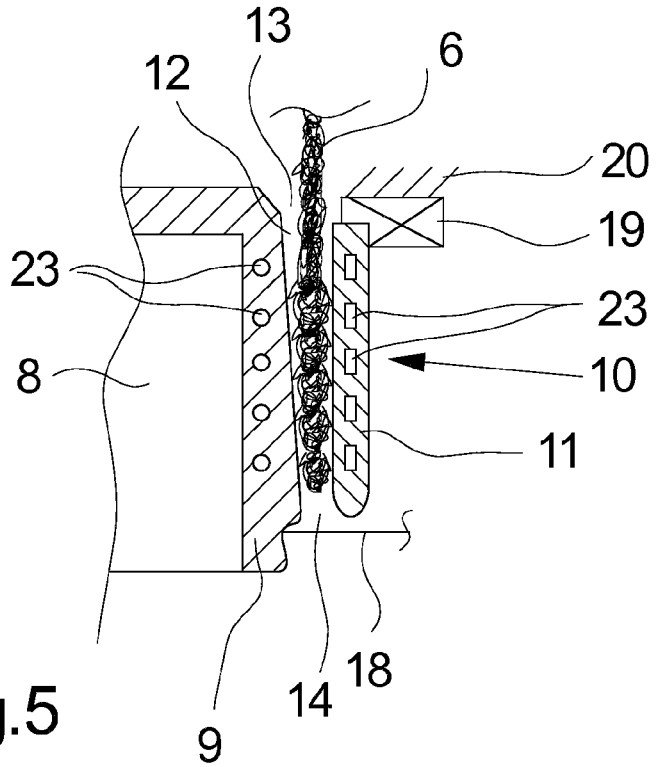
FIG. 5 shows schematically a detail of a cross-sectional view of a further exemplary embodiment of the crimping apparatus according to the invention.

A further exemplary embodiment of the crimping apparatus according to the invention is shown schematically in FIG. 5 by means of a detail of a cross-sectional view of the processing unit 7. In the exemplary embodiment illustrated in FIG. 5 of the processing unit 7, on the circumference of the processing drum 8 an annular chamber 12 is formed between the drum wall 9 and the cylinder wall 11 of the outer cylinder 10. The cylinder wall 11 of the outer cylinder 10 here is configured so as to be a slightly truncated cone, such that a chamber cross section in the annular chamber 12 that tapers off in the axial direction is established. The annular chamber, in the region of the inlet opening 13, includes a chamber cross section which is preferably larger than a diameter of the thread plug 6. On the lower end of the outer cylinder 10 the annular chamber 12 preferably includes a chamber cross section which is smaller than the diameter of the thread plug. In this manner, it is possible, in particular, to perform a setting which is required for the disintegration of the thread plug.

It may be furthermore derived from the illustration in FIG. 5 that the drum wall 9 and the cylinder wall 11 include in each case a plurality of fluid ducts 23 which in each case guide a temperature-controlled fluid for temperature control of the walls 9 and 11. The possibility also exists here for the fluid ducts to be subdivided into a plurality of zones such that, for example, cooling of the thread plug sets in in an upper region of the annular chamber and heating of the thread plug sets in in a lower region of the annular chamber.

The exemplary embodiment illustrated in FIG. 5 moreover offers the particular advantage that the windings of the thread plug 6 are guided on a smooth drum wall 9 and a smooth cylinder wall 11. In this manner, undesirable drawing-in of individual filaments into sleeve openings is not possible. To this extent, the exemplary embodiment as per FIG. 5 is, in particular, particularly suited to yarns having fine counts.

REFERENCE LIST

1 Conveyor nozzle
2 Fluid connector
3 Stuffer box
4 Plug outlet
5 Filament bundle
6 Thread plug
7 Processing unit
8 Processing drum
9 Drum wall
10 Outer cylinder
11 Cylinder wall
12 Annular chamber
13 Inlet opening
14 Outlet opening
15 Holding-down element
16 Drive shaft
17 Blower
18 Thread
19 Bearing unit
20 Upper support
21 Lower support
22 Inner annulet
23 Fluid ducts
24 Rotational drive of outer cylinder
25 Rotational drive of processing drum
26 Motor shaft
27 Electric motor
28 Heating radiator
29 Bearing
30 Guide duct
31 Housing
32 Suction duct
33 Crown gear
34 Gear wheel
35 Gear pair

The invention claimed is:

1. A crimping apparatus for crimping a multifilament bundle in a melt spinning process comprising
- a conveyor nozzle;
- a stuffer box associated with the conveyor nozzle;
- a processing unit to guide and control a temperature of a thread plug produced by the stuffer box;
- a rotatable processing drum having a rotating drum wall; wherein, the stuffer box is disposed axially parallel to the processing drum in such a manner that the thread plug can be infed in a straight run from a plug outlet of the stuffer box to a circumference of the drum wall.

2. The crimping apparatus of claim 1, further comprising an encircling annular chamber configured between an outer cylinder and the drum wall, wherein the annular chamber encompasses the processing drum in a sleeve-like manner to guide the thread plug.

3. The crimping apparatus of 2, wherein the annular chamber includes (i) an inlet opening to an upper end of the outer cylinder, (ii) an outlet opening to a lower end of the outer cylinder between the drum wall and the outer cylinder, and (iii) a chamber cross section that tapers off in the axial direction toward the outlet opening.

4. The crimping apparatus of claim 3, wherein the inlet opening of the annular chamber is associated with a segment-shaped holding-down element that partially covers the inlet opening.

5. The crimping apparatus of claim 2, wherein the outer cylinder is configured to be rotatable and coupled to a rotational drive that drives a cylinder wall in a direction that is in the same direction of rotation as the drum wall of the processing drum.

6. The crimping apparatus of claim 5, wherein the processing drum is driven by an electric motor coupled to the rotational drive of the outer cylinder.

7. The crimping apparatus of claim 2, wherein the drum wall of the processing drum and/or the cylinder wall of the outer cylinder are/is associated with at least one temperature controller for cooling and/or heating.

8. The crimping apparatus of claim 7, wherein the temperature controller provides cooling air and wherein the drum wall of the processing drum is configured to be gas permeable, and the processing drum is coupled to a blower to generate the cooling air.

9. The crimping apparatus of claim 8, wherein the outer cylinder includes a gas permeable cylinder wall.

10. The crimping apparatus of claim 7, wherein the temperature controller provides a fluid which, for temperature control of the drum wall, is guided through fluid ducts within the processing drum.

* * * * *